United States Patent [19]

Schoute et al.

[11] 4,060,369

[45] Nov. 29, 1977

[54] BURNER FOR THE COMBUSTION OF HYDROCARBONATES

[76] Inventors: Bernardus A. Schoute, Einsteinstraat 76, Nijmegen; Gerardus H. Th. M. Verhoeven, Wilgenhoek 23, Zevenaar, both of Netherlands

[21] Appl. No.: 570,967

[22] Filed: Apr. 23, 1975

[30] Foreign Application Priority Data

Oct. 3, 1974 Germany ..... 7433163[U]

[51] Int. Cl.[2] ..... F23M 3/00

[52] U.S. Cl. ..... 431/9; 431/351; 126/91 A; 239/405

[58] Field of Search ..... 431/8, 9, 174, 182–184, 431/284, 351, 352, 353; 126/91 A; 239/404, 403, 405

[56] References Cited

U.S. PATENT DOCUMENTS

| | | | |
|---|---|---|---|
| 2,167,183 | 7/1939 | Naab et al. | 431/284 |
| 2,231,244 | 2/1941 | Berthiaume et al. | 431/351 |
| 2,787,318 | 4/1957 | Wolfersperger | 431/9 |
| 2,796,118 | 6/1957 | Parker et al. | 431/351 |
| 3,362,647 | 1/1968 | Davis et al. | 239/404 |
| 3,612,737 | 10/1971 | Sharam | 239/404 |
| 3,671,172 | 6/1972 | Chedaille et al. | 431/174 |
| 3,822,654 | 7/1974 | Ghelfi | 431/284 |
| 3,870,456 | 3/1975 | Graat | 431/8 |
| 3,972,182 | 8/1976 | Salvi | 239/404 |

*Primary Examiner*—Carroll B. Dority, Jr.
*Attorney, Agent, or Firm*—Cushman, Darby & Cushman

[57] ABSTRACT

A method and apparatus for burning oil or gas mixed with air to produce a long stable flame in which the fuel is atomized in a chamber by a primary atomizing medium introduced tangentially into the chamber to form a confined stream, secondary air moving parallel to the confined streams mixed with the stream which is then expanded and tertiary air supplied to the stream in a helical swirling path about the stream periphery.

5 Claims, 9 Drawing Figures upper half lower half

BURNER FOR THE COMBUSTION OF HYDROCARBONATES

The present invention relates to a method of combustion and to a burner, especially for the combustion of liquid fuels with air whereby the combustion gases from inert gases. In the course of the method, the fuel is atomized under pressure by tangential introduction and admixture of a medium ("primary air"). Then, another volume of air ("secondary air") is supplied from the outside to the flow or thus formed.

A method of this type is described in applicant's German patent application 2,320,442 laid open to public inspection*. The method disclosed in this prior applications is satisfactory for the combustion of liquid fuels, and this method is applied in a great number of commercially installed burners.

However, the present energy supply situation causes the desire in many customers to obtain a burner which, without any substantial difficulty in conversion, can be operated alternatively with liquid or gaseous fuels. In general, however, the combustion of gases requires a different technology and configuration of the burner to be applied than in oil burners. Accordingly, it is the primary object of the present invention to provide a method and a burner which allows to be converted for combustion of the respective other type of fuel without difficulty and without intricate manipulation.

On the other hand, it is another object of the present invention to render possible the ready structural modification of the burner in such a way that uniform and complete combustion over a greater distance is provided such that a uniform heat transmission or transfer is ensured particularly when the burner is used for so-called tunnel furnaces. Hereby, "hot spots," i.e. local overheating, should be avoided, as such hot spots might affect the furnace operation.

The above objects are solved in the method of the above-indicated type in that upon introduction of the secondary air the burning mixture is allowed to expand, and that another volume of air ("tertiary air") is supplied within the transition area between the small and the large volumes.

It has been found to be of particular advantage if the tertiary air is supplied in a helical swirling path at the periphery of the volume restriction. This results in that the relatively cool tertiary air forms an insulation for the hot combustion gases relative to the wall of the burner tube, whereby this air is admixed to the burning mixture only after some extended distance thereby to produce a stable flame configuration.

The method can be realized in a burner having an atomizing portion. Such atomizing portion is disclosed in the abovementioned patent applications. This atomizing portion includes an atomizing passage and tangential feed passages for an atomizing medium, preferably air (primary air). The mouth of an atomizing passage has positioned downstream thereof another air supply (for secondary air). The novel feature resides in that a burner tube is arranged around the mouth of the atomizing passage, which burner tube is extended into the direction of the burner axis, whereby the mixture is passed through the interior thereof. It is considered to be a feature essential to the invention that the mouth of the burner tube has arranged downsteam thereof a further air supply means ("tertiary air") through which the remainder of the combustion air is supplied. In order to feed especially the tertiary air in helical swirling paths, an inlet opening for the tertiary air is provided which is

*(corresponds with now abandoned U.S. Ser. No. 369,197 of May 5, 1973)

positioned tangentially of the shell of the burner tube and substantially perpendicularly to the burner axis. Due to the tangential feed, the tertiary air is imparted a swirling motion towards the combustion zone, whereby the air masses are urged to the periphery by centrifugal force. In this way, a metered addition of the tertiary air to the gases or oil droplets to be burned is obtained across an extended distance, whereby an insulation of the hot combustion zone from the wall is simultaneously effected by the rotating flow of air.

A special advantage and a surprising effect reside in that the burner, in addition to its use as an oil burner, may be used also as a gas burner. To this end, a fuel gas/air mixture is fed in through the secondary air supply, and air is blown in or injected through the atomizing portion (without oil). It has been found that no variation of the burner mouth or of the inner structure of the burner is required; rather, conversion from one fuel to the other can be made directly. Apparently, this effect is due to the fact that the gases are supplied within the central portion of the burner, whereby additional combustion air is supplied on the one hand coaxially within the center and on the other hand in a coaxial-tangential fashion.

Another advantage of the present invention is the fact that, although a long flame having acorrespondingly low temperature is formed within the head portion, this flame nevertheless can be ignited by means of a spark plug without thereby causing the deposition of contaminants. Prior condition to this effect is an extremely good atomization within the burner according to the present invention.

In contrast with this flame, an ignition flame is of complicated nature because it must be fired again and monitored, and gas and air supplies are required to this end.

It is advantageous that the above-described burner can be followed by a long heater tube whereby velocity and quantities or volumes of supply of the individual components may be metered in such a manner that combustion takes place over an extended distance within the heater tube which is thereby uniformly heated. Also, the heater tube may include a plurality of elbow sections such that it may act to heat the air passing along these sections.

In the following, exemplary embodiments of the present invention are explained in greater detail by referring to the enclosed drawings, wherein.

Figure 6:
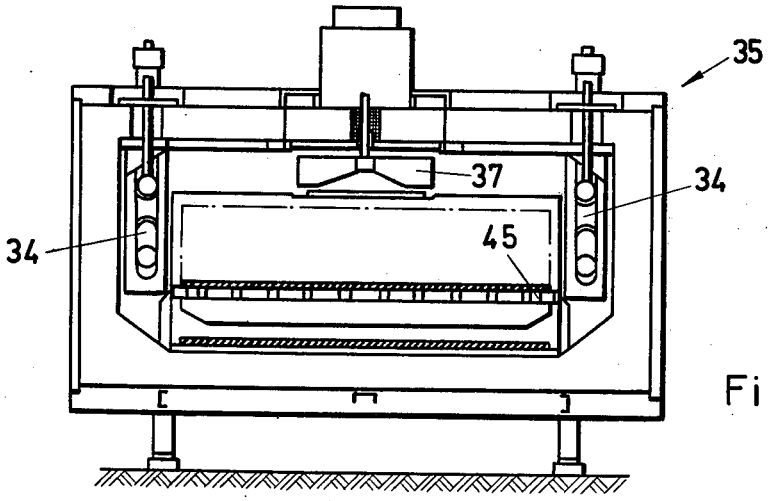
Figure 5A:
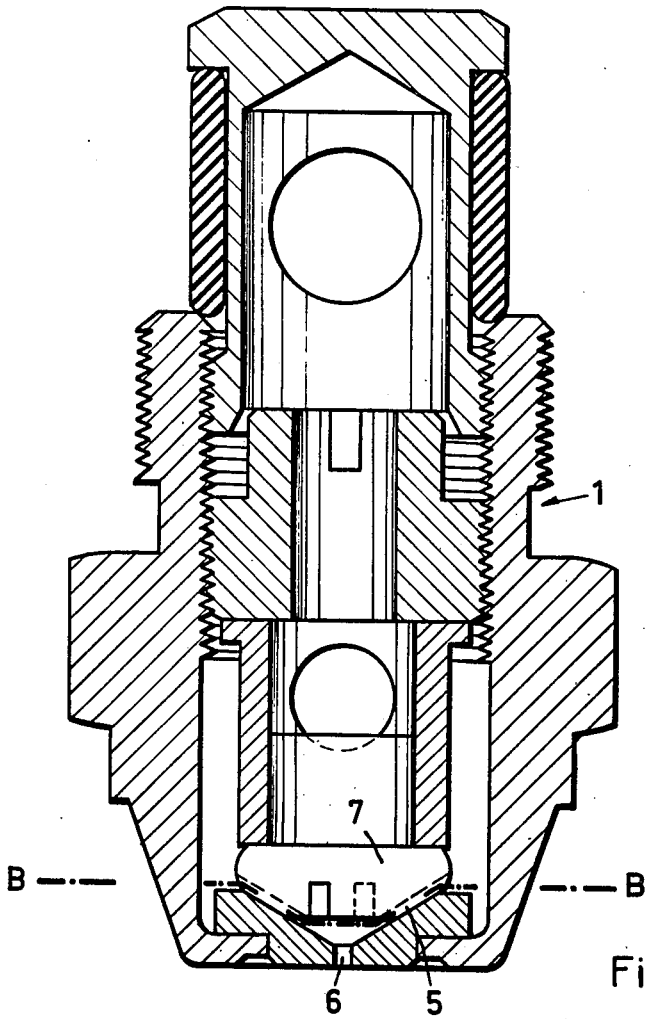
Figure 5B:
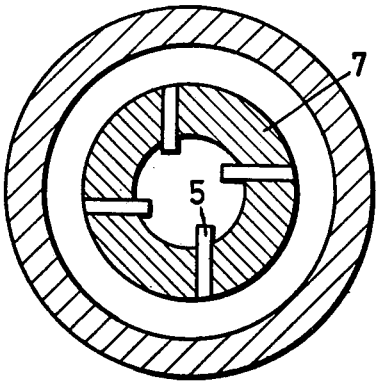
Figure 7:
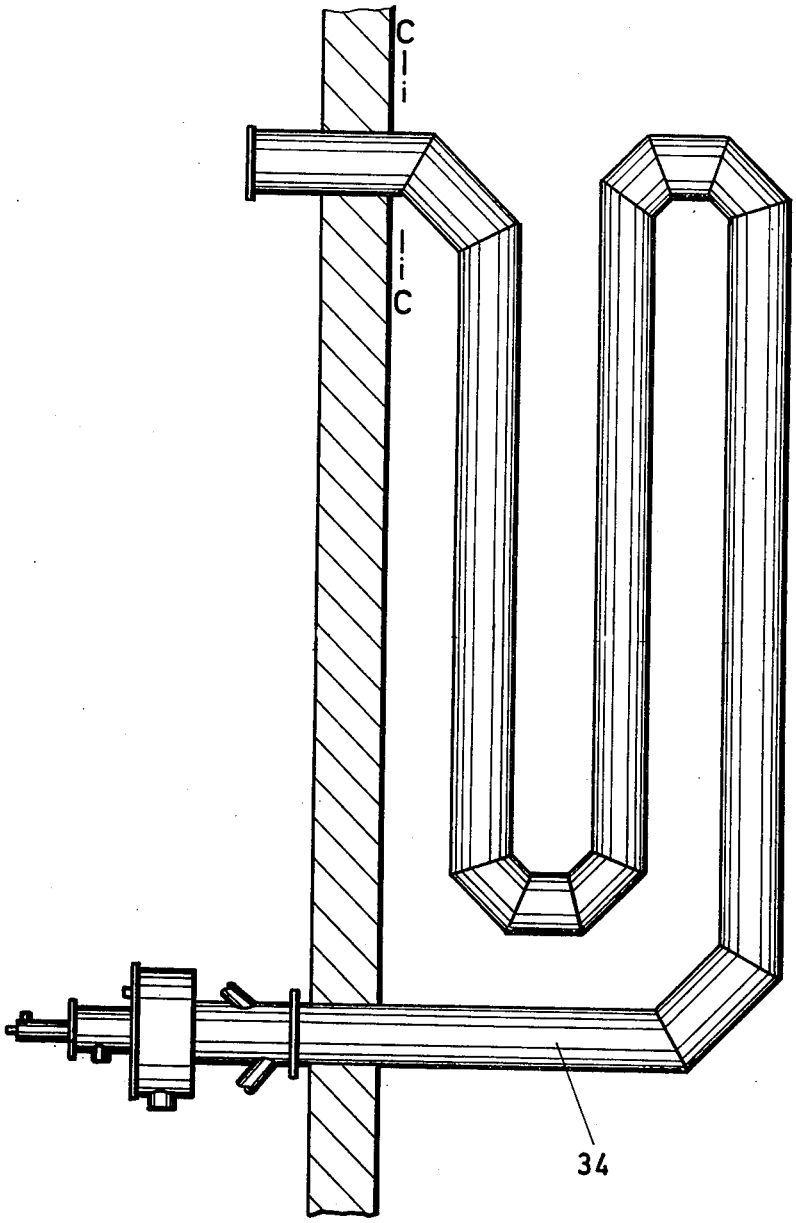

FIGS. 5A und 5B illustrate a pressure atomizier for liquid fuel;

FIG. 6 shows a tunnel furnace having a special embodiment of the burner installed therein and FIG. 7 is a view of the burner including its subsequent bent heater tube.

Figure 1:
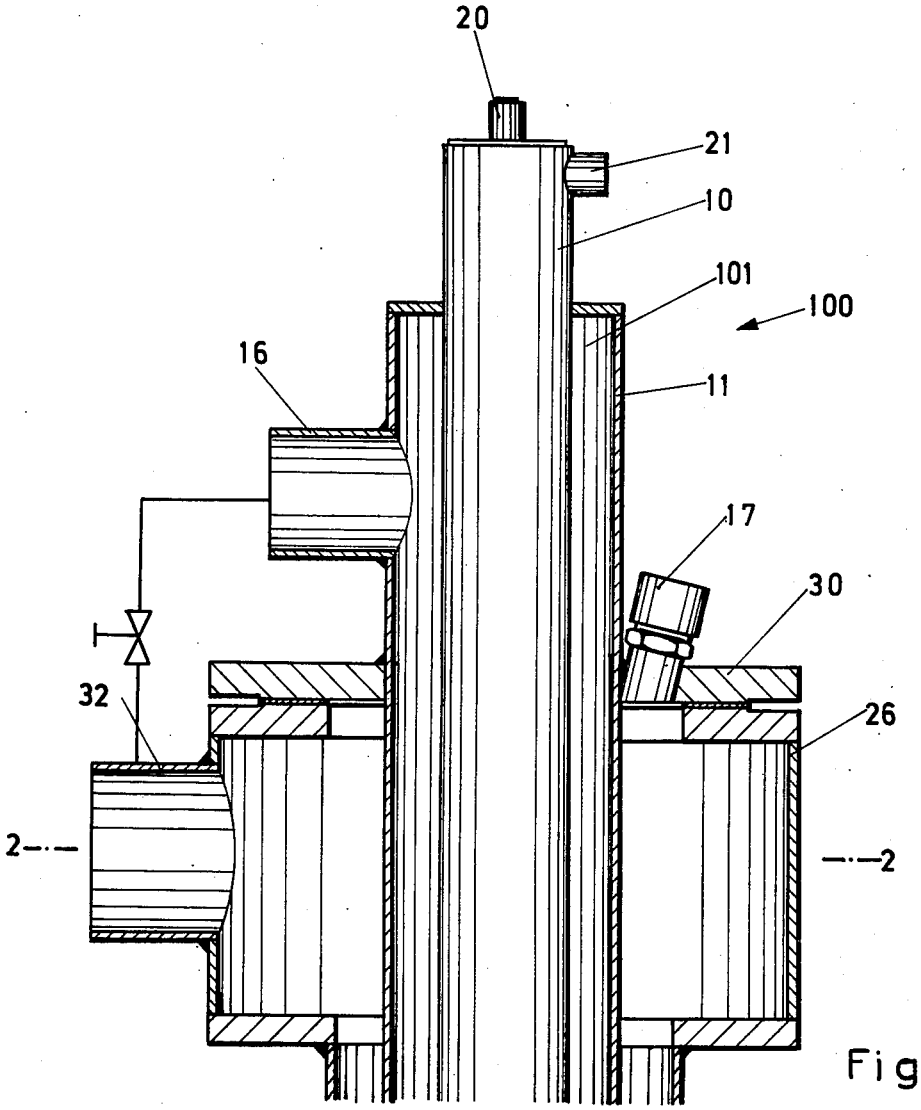
FIG. 1 shows a sectional view of a burner according to the present invention.
Figure 1:
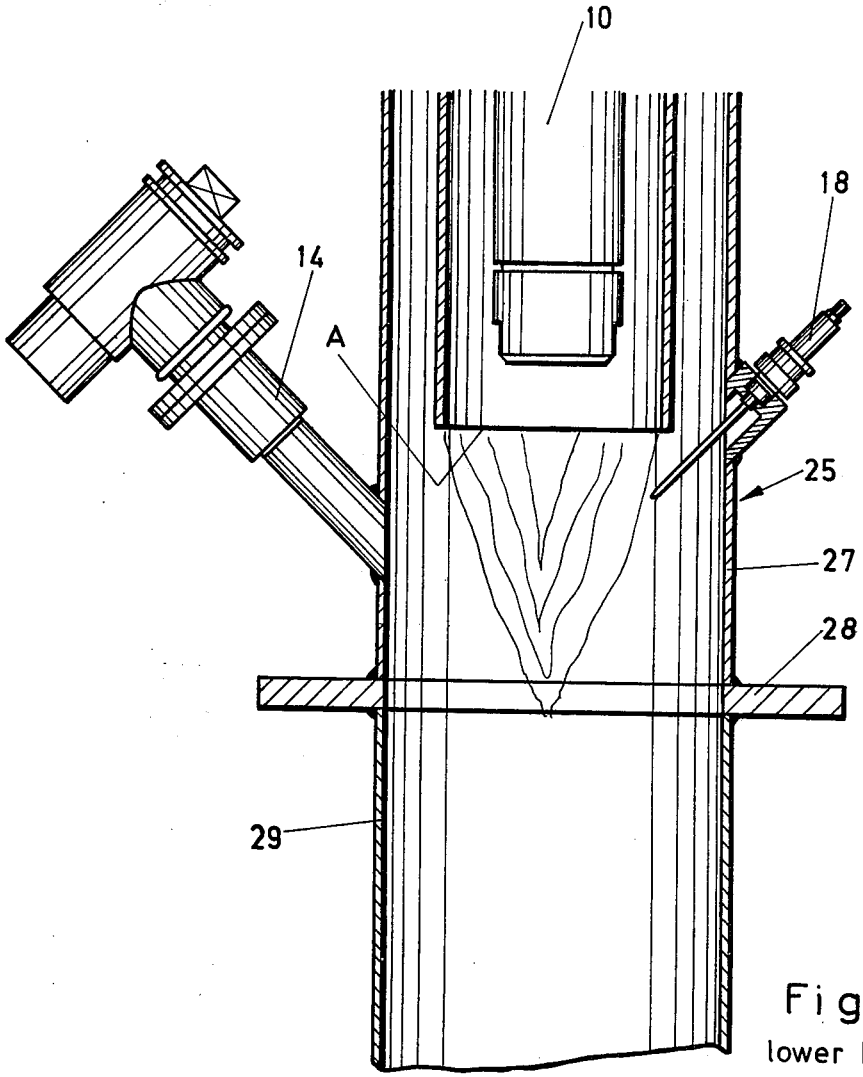

As the burner shown in FIG. 1 is similar to the burner according to the laid-open German patent application 2,230,442 and U.S. patent application Ser. No. 369,197, filed May 5, 1973 and now abandoned, in some technical details, the same reference numerals as in this prior application have been used for identical parts. Those parts which are necessary for the understanding of the functioning, but which are of no essential importance to the invention, are described in a less detailed manner.

Further details of these items may be gathered respectively from the abovementioned prior applications.

The burner which is generally shown at 100, includes an outer housing 25 of stepped configuration, which housing is formed in cylindrical-symmetrical fashion e.g. from steel plate or from cast iron. The upper, wider portion 26 tapers into a lower portion 27 which terminates in a flange 28 and which may join the initial portion 29 of a heater tube. However, it is also possible to have the hot combustion gases to exit freely, for example into a spray cooling means.

A firing device (spark plug 18) extends into the housing 23 from its outer side. Besides, a UV (ultra-violet) flame monitor 14 is provided.

The upper portion 26 is closed by a housing cover or an upper plate 30 which has a viewing glass 17 installed therein. Further, the housing cover 30 encloses the cylindrical shell of the inner burner portion 101, whereby the latter is similar in structure to the burner according to U.S. patent application Ser. No. 369,197, filed May 5, 1973 and now abandoned. This burner portion includes an atomizing portion 10 being provided with a pair of connections for oil supply 20 and for the supply of the atomizing air (primary air) 21. Additionally, the cylindrical shell 11 includes a lateral supply or feeder line 16 for combustion air (secondary air). The atomizing portion 10 is substantially elongated as compared with the atomizing portion according to the abovementioned prior application.

Figure 3:
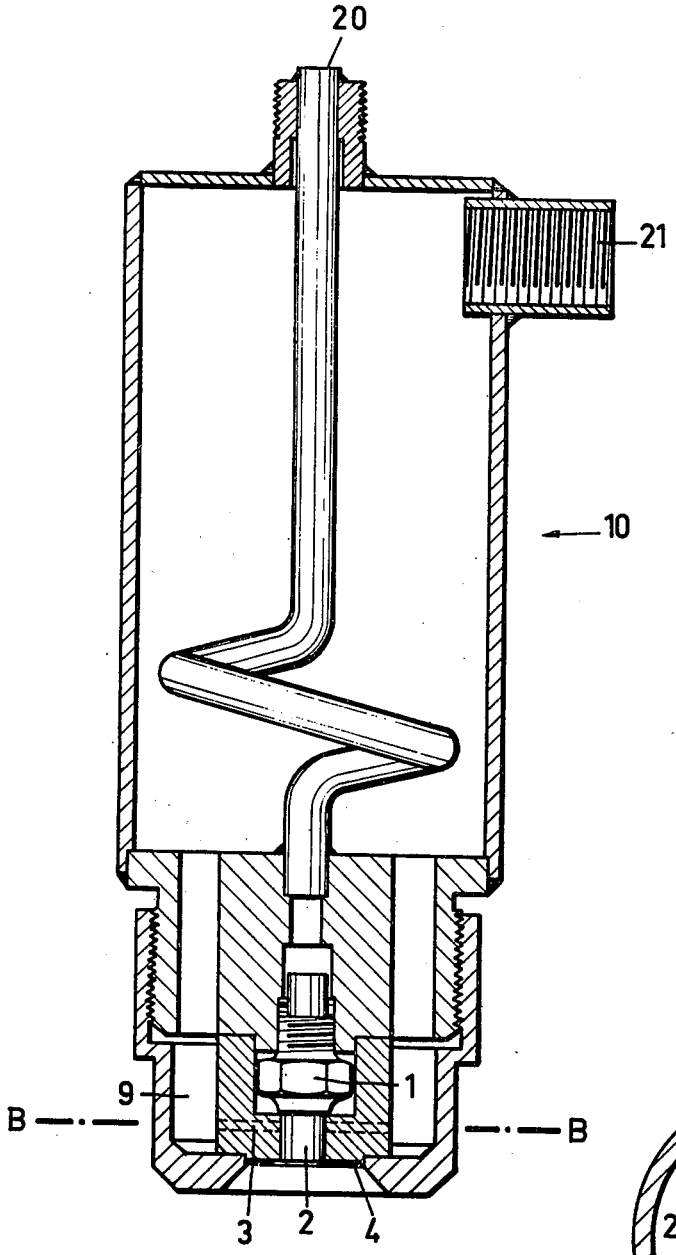
FIGS. 3 and 4 illustrate an embodiment of the atomizing nozzle.
Figure 4:
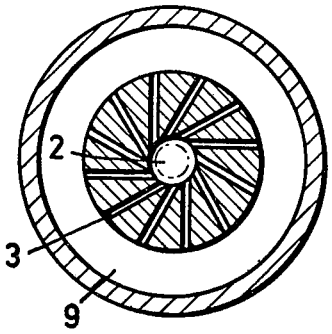

As can be seen from FIG. 3 and 4, oil is supplied through line 20. The compressed air passes through the free space of the atomizing portion 10 and through an annular passage 9 into the radial or star-shaped, tangentially disposed passages 3 with are arranged around an atomizing passage 2 in the lower part of the atomizing portion 10. The oil line or pipe terminates in a mechanical pressure atomizing nozzle 1 for the fuel, which nozzle terminates shortly above of the atomizing passage 2. The tangential passages 3 supply the atomizing medium in a plane extending normally or obliquely relative to the burner axis.

Details of the atomizing nozzle 1 for the liquid fuel supplied are shown in FIGS. 5A und 5B. The fuel is passed to an injection orifice 6 through tangential passages 5 inclined relative to the burner axis, to be atomized and so as to form minute droplets at such orifice, whereupon the fuel is intimately mixed with the atomizing air or atomizing medium and then guided over the spark plug. The cylindrical shell 11 is extended beyond the mouth of the atomizing nozzle such that the secondary air fed within the shell 11 is permitted to be initially mixed intimately with the fuel/air mixture. The shell 11 terminates at an edge A such that the available volume may expand into an enlarged cross-section. Now, the auxilliary combustion air is supplied in spiral or helical vortices to this enlarged cross-section part within the lower portion 27 of the housing 25. However, it may be noted that a supply through axially disposed annular passages in parallel with the axis may be expedient, too, for specific combustion purposes. Furthermore, the secondary air may be branched off from the tertiary air, optionally under control, or vice versa (FIG. 1).

Figure 2:
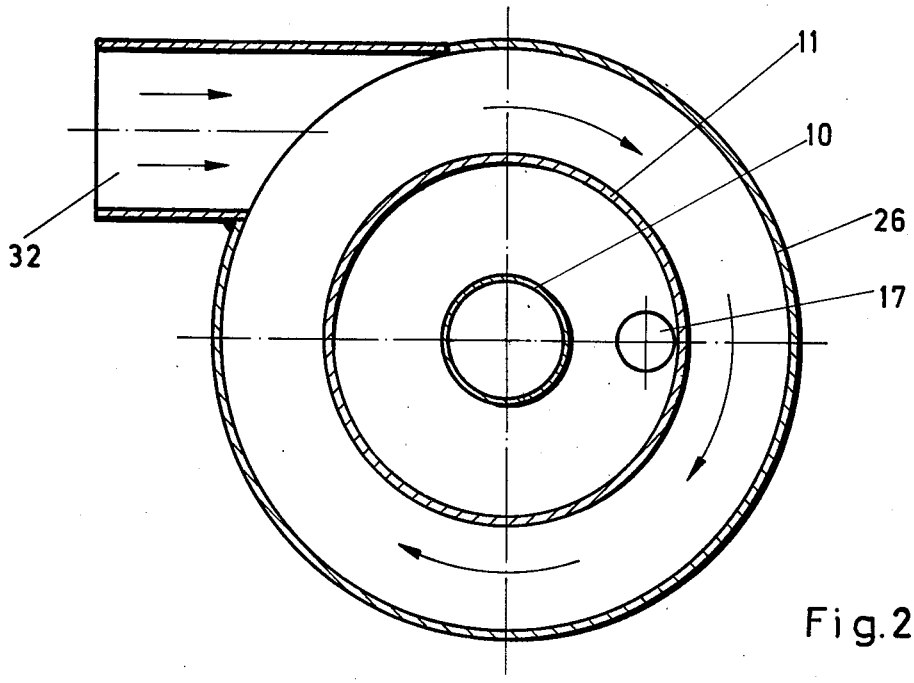
FIG. 2 shows a cross-sectional view along lines 2—2 of FIG. 1.

According to FIG. 2, the helical path of the supplied air is achieved by an air supply (pipe) 32 of the so-called tertiary air, which is arranged in tangential relation to the circumference of the housing. The air put into rotary motion is urged against the shell 25 by centrifugal force, and it provides within the lower portion 27 a thermal insulation from the hot combustion flame within the inner portion of the housing 25.

In this construction, it is particularly surprising that the above-described burner can be operated also with a fuel gas in the place of oil or other liquid fuel. To this end, the oil line 20 is closed, and preferably compressed air is further blown in through the pipe 21. Hereby, a strong zone of flame is provided which is visible and measurable in the flame monitoring device.

A gas/air mixture is blown in through line 16 to flow into the combustion or burner zone below the edge of shell 11. In this region, the tertiary air is further admixed to the mixture which air in a helical configuration is admixed to the combustion flame in metered fashion over an extended path so as to provide for further or enhanced combustion.

It has been found that by the supply of the tertiary air in the form of helical swirling paths, the combustion takes place gradually over a greater distance. Accordingly, it is possible to connect an elongated, bent or elbow-shaped heater tube 34 to the burner opening, which heater tube is uniformly heated substantially over the full length thereof, whereby local places tending to become overheated may be substantially avoided. A tube of this kind may be employed, for instance, in a tunnel furnace 25 (s. FIG. 6). Such tunnel furnace is described on principle in applicant's laid-open German patent application 2,344,138. The articles resting on a conveyor belt 45 are surrounded by hot air which is circulated across the heater tube bent or elbow by means of a fan or blower 37.

As the hot combustion gases, apparently, are not directly fed into the furnace chamber, a substantially "cleaner" atomsphere can be provided than in the case of the direct feed.

With respect to the mode of operation of the burner, it has to be noted further (compare FIG. 7) that the base of the flame lies in the the edge of shell 11 and that all of the fuel is to be burned completely not before the plane C—C.

What we claim is:

1. A method of burning liquid fuel with air so as to produce a long stable flame comprising:

atomizing said fuel by swirling; mixing said fuel with primary air by introduction under pressure the primary air into a flow of said swirling fuel tangential to the direction of said flow and forming a confined cylindrical stream; releasing said confined stream;

introducing secondary air flowing parallel to said released stream into said confined stream;

expanding said released stream from a first to a second cross-section larger than said first cross-section during introduction of said secondary air; and supplying tertiary air to said stream in a helical swirling path about the periphery of said second cross-section and within a transition between said second cross-section and a larger cross-section so that said tertiary air is admixed with the burning mixture over an extended distance to produce a stable flame.

2. A burner for the combustion of a liquid hydrocarbon fuel with air to produce a long stable flame comprising:

means for whirling and atomizing said fuel including a cylindrical atomizing chamber having a discharge end, means for whirling said fuel into said chamber as a flow and means defining feed passages for introducing primary air into said chamber tangential to the direction of said flow to form an atomized fuel mixture and produce a confined flow of said atomized fuel mixture;

a first burner tube disposed about said atomizing chamber, extending in the direction of said flow, and terminating in an open mouth;

means for supplying secondary air to said burner tube so that the supplied air moves in parallel to said flow about the periphery thereof and is mixed therewith as it exits the discharge end of said chamber and exits through said open mouth;

a second burner tube disposed about said first tube and extending in the direction of said flow past said open mouth; and means for supplying tertiary air to said second burner tube so that the supplied air moves in parallel to the flow exiting from said mouth and so that the supplied air flows helically about the periphery of the flow from said open mouth and said tertiary air is admixed to the burning mixture over an extended distance to produce a stable flame.

3. The burner according to claim 2 further including a long heater tube connected to said second tube, whereby the combustion takes place over the full length of said heater tube.

4. The burner according to claim 3, wherein said heater tube includes a plurality of elbow sections.

5. The burner according to claim 2, including a spark plug.

* * * * *